US011006699B1

(12) United States Patent
Goodwin et al.

(10) Patent No.: US 11,006,699 B1
(45) Date of Patent: May 18, 2021

(54) MAGNETIC BUCKLE

(71) Applicant: Peter Goodwin, Spring Hill, TN (US)

(72) Inventors: Peter Goodwin, Spring Hill, TN (US); George Brooks, Spring Hill, TN (US); Cody Hutchins, Spring Hill, TN (US); Salmon Nortje, Cape Town (ZA)

(73) Assignee: Peter Goodwin, Spring Hill, TN (US)

( * ) Notice: Subject to any disclaimer, the term of this patent is extended or adjusted under 35 U.S.C. 154(b) by 0 days.

(21) Appl. No.: 17/164,665

(22) Filed: Feb. 1, 2021

Related U.S. Application Data

(60) Provisional application No. 62/969,110, filed on Feb. 2, 2020.

(51) Int. Cl.
*A44B 11/25* (2006.01)

(52) U.S. Cl.
CPC ..... *A44B 11/2546* (2013.01); *A44D 2203/00* (2013.01)

(58) Field of Classification Search
CPC ..... A44B 11/2546; A44B 11/258; A44D 2203/00
See application file for complete search history.

(56) References Cited

U.S. PATENT DOCUMENTS 3,341,906 A * 9/1967 Williams ..... A44B 11/258 24/303
6,857,169 B2 * 2/2005 Chung ..... A44B 11/258 24/303
8,914,951 B2 * 12/2014 Gaudillere ..... A44B 11/266 24/303
9,307,808 B1 * 4/2016 Lill ..... A44B 99/00
9,936,772 B2 * 4/2018 Paik ..... A45F 3/047
10,085,521 B2 * 10/2018 Chen ..... A45C 13/1069
10,143,270 B2 * 12/2018 Fiedler ..... A44B 11/2588
2004/0259468 A1 * 12/2004 Bergamelli ..... A44B 11/258 450/58
2014/0277103 A1 * 9/2014 Esposito ..... A44B 11/258 606/203
2018/0132570 A1 * 5/2018 Chen ..... A41F 1/002

* cited by examiner

*Primary Examiner* — Robert Sandy
(74) *Attorney, Agent, or Firm* — Eric B. Fugett; Mark A. Pitchford; Pitchford Fugett, PLLC

(57) ABSTRACT

A magnetic buckle includes first and second buckle members. The first buckle member includes a first end and a second end adapted to engage a strap, a mounting surface, a latching aperture defined in the mounting surface, and a first magnet. A release direction extends along a longitudinal axis of the first buckle member from the first end to the second end. The second buckle member includes a joining surface adapted to be joined with the mounting surface, a latch hook adapted to engage the latching aperture extending from the joining surface, and a second magnet. The magnets pull the latch hook into engagement with the latching aperture when the joining surface is placed in proximity to the mounting surface. Engagement of the latching aperture by the latch hook prevents the second buckle member from being pulled apart from the first buckle member in a direction orthogonal to the mounting surface or against the release direction.

20 Claims, 9 Drawing Sheets

MAGNETIC BUCKLE

CROSS-REFERENCES TO RELATED APPLICATIONS

This non-provisional patent application claims priority to U.S. Provisional patent Application Ser. No. 62/969,110, filed Feb. 2, 2020 and titled "BELT BUCKLE ASSEMBLY," the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The invention relates generally to the field of closure devices, and more particularly, to buckles for releasably connecting two ends of one or more straps.

Buckles are used every day all over the world to releasably secure opposing ends of a belt around a user's body. Many conventional two-piece buckles have multiple moving and/or flexible parts which require two hands and significant dexterity to manipulate. Currently available magnetically-assisted buckles are no exception, as they too require appreciable fine motor skills to operate. For example, buckles with depressible release buttons, flexible arms, movable release catches can be particularly challenging to unlatch, especially with only one hand. The moving and/or flexible parts of such buckles also tend to wear out after a certain number of use cycles, requiring replacement of the worn part or the entire buckle. Accordingly, a need exists for a more durable buckle which can be operated with only one hand. What is needed then are improvements in buckles.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

Disclosed herein is a durable magnetic buckle with no moving parts or wear parts. The buckle comprises a magnetic male buckle member and a magnetic female buckle member. The male buckle member includes male latching means which releasably engages corresponding female latching means in the female buckle member. A magnet is arranged within each buckle member. The magnets are arranged so as to be offset from each other along a longitudinal axis of the buckle when the buckle is latched. The magnet of the male buckle member is offset from the magnet of the female buckle member in a release direction such that magnets pull the male latching means into the corresponding female latching means when opposing interfacing surfaces of the buckle members are placed in proximity to each other. The offset magnets also maintain the buckle in a latched condition until manually unlatched. When latched, the male buckle member cannot be pulled apart from the female buckle member in a direction either orthogonal to the interfacing surfaces or against the release direction. The female buckle member is provided with a plurality of angled guide surfaces which interface with corresponding opposing surfaces of the male buckle member during operation. The guide surfaces facilitate one-handed unlatching of the male buckle member from the female buckle member by translating the latching means out of engagement and releasing the male buckle member from the female buckle member when the male buckle member is displaced in the release direction relative to the female buckle member.

The present invention is of particular significance when used in connection with a strap of webbing or other material sized to be worn around a user's body as a belt, and that application of the present invention is described herein in detail. However, the present invention may also have application to straps used to connect two parts of an item (e.g., of a backpack or rucksack). Numerous other objects, advantages, features, and applications of the present invention will be readily apparent to those of skill in the art upon a review of the following drawings and description of a preferred embodiment.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention.

Those of ordinary skill in the art will recognize numerous equivalents to the specific apparatus and methods described herein. Such equivalents are considered to be within the scope of this invention and are covered by the claims.

To facilitate the understanding of the embodiments described herein, a number of terms are defined below. The terms defined herein have meanings as commonly understood by a person of ordinary skill in the portions relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

This description and appended claims include the words "below", "above", "over," "under," "side", "top", "bottom", "upper", "lower", "when", "vertical", "horizontal", "upright", etc. to provide an orientation of embodiments of the invention to allow for proper description of example embodiments. The foregoing positional terms refer to the assembly when in the orientation shown in FIG. 1. A person of skill in the art will recognize that the assembly can assume different orientations when in use.

Figure 1:
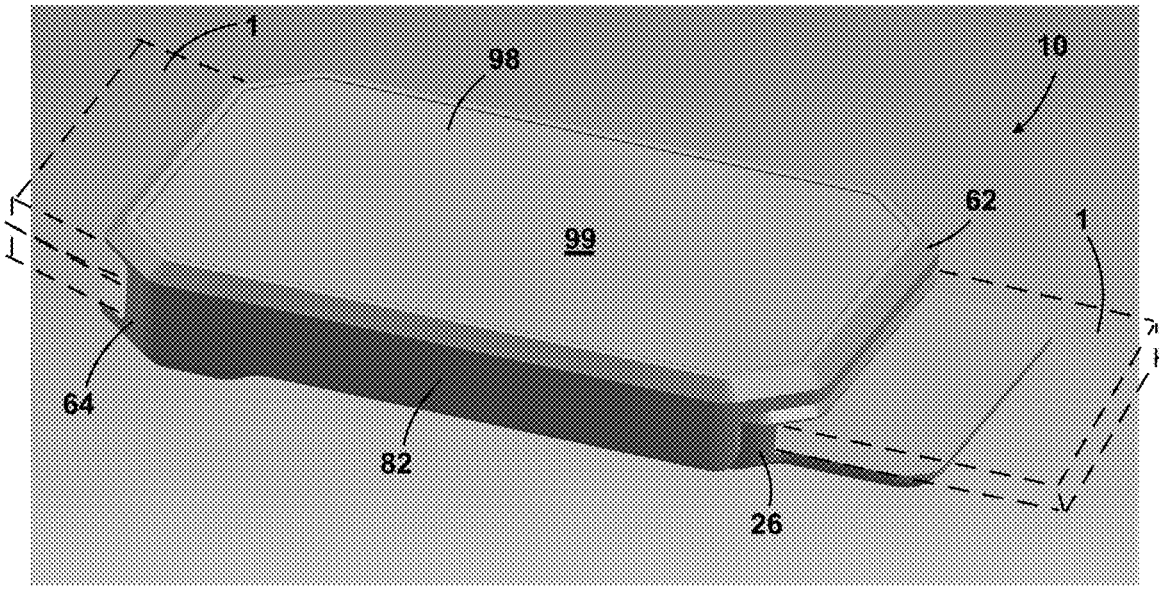
FIG. 1 is an elevated fragmentary isometric assembled view of an embodiment of a magnetic buckle constructed in accordance with the invention showing the buckle in a latched condition and engaged with an exemplar strap.

Similarly, an "upright" position as described herein is considered to be the position of the apparatus or assembly components while in proper operation or in a natural resting position as described and shown herein, for example, in FIG. 1. It is also contemplated that embodiments of the invention may be in orientations other than upright without departing from the spirit and scope of the invention as set forth in the appended claims. Further, the terms "above", "below", "over", and "under" mean "having an elevation or vertical height greater or lesser than" and are not intended to imply that one object or component is directly over or under another object or component, unless specifically indicated to the contrary. The term "when" is used to specify orientation for relative positions of components, not as a temporal limitation of the claims or apparatus described and claimed herein unless otherwise specified.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Figure 2:
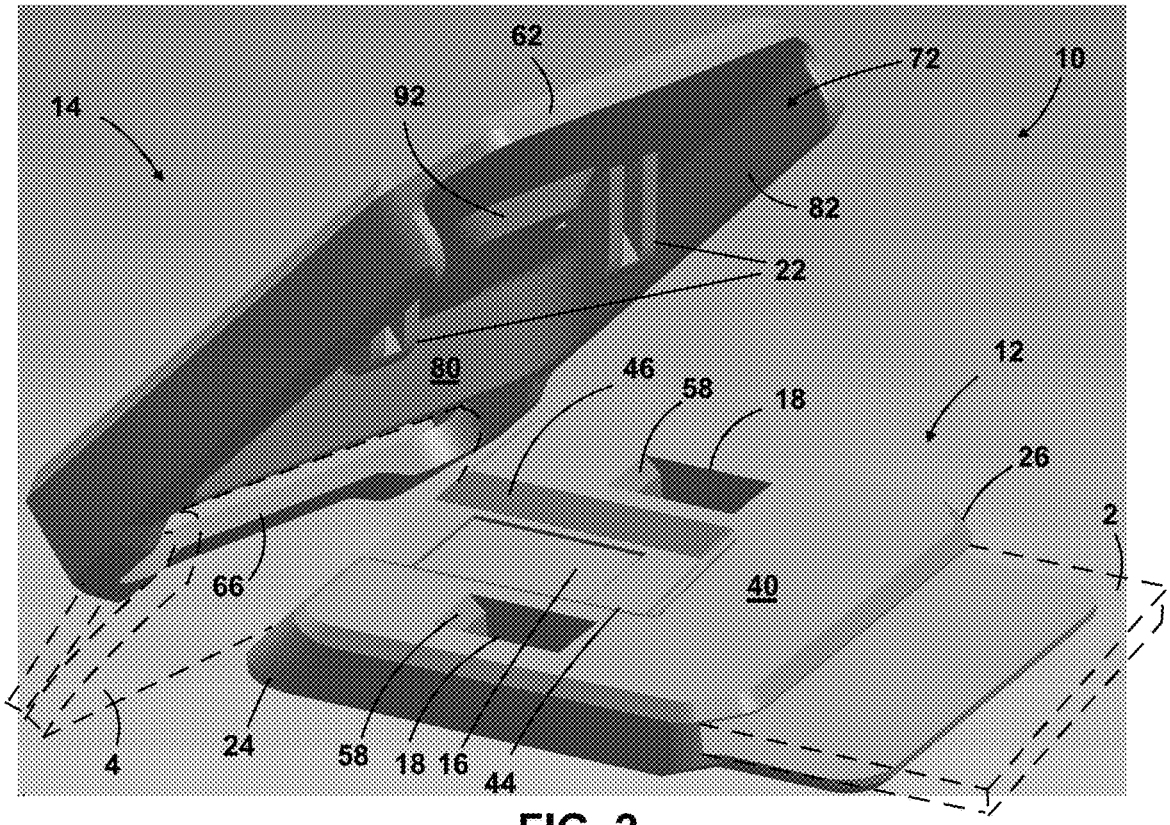
FIG. 2. is another fragmentary isometric view of the objects of FIG. 1 showing the buckle in an unlatched condition.

Referring initially to FIGS. 1-2, depicted therein is an embodiment of a magnetic buckle 10 constructed in accordance with, and embodying, the principles of the present invention. The magnetic buckle 10 includes a first magnetic buckle member 12 and a second magnetic buckle member 14. The first and second buckle members 12, 14 can be formed as individual monolithic structures from any suitably strong, durable, and rigid material. The buckle 10 is depicted as attached to a strap 1 having a first end 2 and a second end 4. The first end 2 of the strap 1 is securely engaged to the first buckle member 12, while the second end 4 of the strap 1 is adjustably engaged with the second buckle member 14, as will be described in more detail below. The strap 1 can be formed from a variety of flexible materials from which straps and belts are known to be formed, including leather, webbing, and the like. The strap 1 by itself does not form a part of the invention.

The first buckle member 12 is a female buckle member which includes a first magnet 16 and a pair of latching apertures 18. The second buckle member 14 is a male buckle member which includes a second magnet 20 and latching means exemplified by a pair of latch hooks 22. The latch hooks 22 of the second buckle member 14 are receivable in and engageable with the latching apertures 18 of the first buckle member 12 whereby the buckle 10 is latched. The first and second magnets 16, 20 are attracted to each other via an attractive magnetic force and are arranged within each buckle member 12, 14 so that the magnets pull the latch hooks 22 into engagement with the latching apertures 18 when the respective buckle members 12, 14 are placed in proximity to each other. Each of the first and second magnets 16, 20 can be a permanent magnet such as a neodymium magnet. Suitable neodymium magnets can have a grade of N30, N35, N38, N42, or N52. Other types of magnets suitable for use in the present invention will be apparent to ordinarily skilled artisans.

The first and second magnets 16, 20 are also offset from one another within the respective first and second buckle members 12, 14 so that the attractive magnetic force between the magnets 16, 20 causes them to attempt to vertically align when placed in proximity to one another. This biases the latch hooks 22 into engagement with the latching apertures 18 and maintains the buckle 10 in a latched condition until the buckle 10 is manually unlatched as described below. In this way, the second buckle member 14 is releasably engageable with the first buckle member 12 to secure the ends 2, 4 of the strap 1 around a person or an object. It is to be understood that the magnetic buckle 10 can be used to secure together opposite ends 2, 4 of a single strap 1 or to connect ends of two separate straps which may be attached to an object such as a backpack. As such, the utility of the magnetic buckle 10 disclosed herein is not limited to use as a belt buckle. With the foregoing general principles of the invention understood, the construction and operation of the magnetic buckle 10 will now be described in detail.

Referring now to FIGS. 3-14, the first buckle member 12 includes a first end 24 defining a slanted or angled surface 25 and a second end 26 defining a slot 27 in which strap 1 is receivable. The first end 2 of the strap 1 is releasably secured in the slot 27 by a plurality of threaded fasteners 28, which can be set screws. The fasteners 28 extend through threaded holes 30 defined in the second end 26 of buckle member 12 to engage the strap 1 and secure it within the second end 26. In other embodiments, the first end 2 of the strap 1 can be secured in the slot 27 by a plurality of teeth (not shown). The teeth can extend from a hinge connected to the first buckle member 12 and adapted to releasably compress and thereby retain the strap in the slot 27. A flattened tongue 31 extends outwardly a distance from the second end 26 to support and protect the first end 2 of the strap 1.

The first buckle member 12 defines a lateral axis 32, a longitudinal axis 34, and a release direction 36 extending along the longitudinal axis 34 from the first end 24 to the second end 26. The first buckle member 12 also defines a backing surface 38 and a mounting surface 40 which defines a reference plane 42. The latching apertures 18 are defined in the mounting surface 40. The latching apertures 18 can extend partially or completely through the first buckle member 12 from the mounting surface 40 to the backing surface 38.

An elongated depression 44 is defined in the mounting surface 40 between the latching apertures 18 such that the latching apertures 18 are laterally spaced from the depression 44 and each other. The depression 44 includes a plurality of angled side walls 46 extending from the mounting surface 40 to a bottom surface 48 of the depression 44. A recess 50 sized and shaped to receive the first magnet 16 can be defined in the bottom surface 48 of the depression 44. The first magnet 16 can be secured in the recess 50 by securing means such that the magnet 16 is recessed from the mounting surface 40 and the reference plane 42. Suitable securing means include, but are not limited to, adhesives and mechanical fasteners. The recess 50, and thus the first magnet 16, is arranged closer to the free first end 24 of the first buckle member 12 than the latching apertures 18. This facilitates the first and second magnets 16, 20 pulling or drawings the latch hooks 22 into the latching apertures 18 and maintaining the latch hooks 22 in engagement with the latching apertures 18 as will be explained below.

In some embodiments, the recess 50 in which the first magnet 16 is secured can be formed in a backing surface 38 of the first buckle member 12. In such embodiment, the first magnet 16 can be separated or spaced from the bottom surface 48 of the depression 44 by a thin layer of the constituent material from which the first buckle member 12 is formed. This protects the first magnet 16 from becoming dislodged or otherwise unsecured from the recess 50 during use of the buckle 10. In still other embodiments, the first magnet 16 can be received in a passage (not shown) defined through a side of the first buckle member 12.

Each latching aperture 18 includes a first end wall 52 and a second end wall 54. The first end wall 52 is closer to the first end 24 of the first buckle member 12 than the second end 26 of the first buckle member 12, while the first magnet 16 and the recess 50 in which it is secured is arranged closer to the first end 24 of the first buckle member 12 than the first end wall 52 of the latching apertures 18. Each first end wall 52 defines a ledge 56 with which a latch hook 22 is engageable. Engagement of the latch hooks 22 with the vertical portions of the first end walls 52 prevents the second buckle member 14 from being pulled apart from of the first buckle member 12 in a direction against (i.e., opposite from) the release direction 36 when the buckle 10 is latched. Engagement of the latch hooks 22 with the ledges 56 prevents the second buckle member 14 from being pulled apart from of the first buckle member 12 in a direction orthogonal to the reference plane 42 when the buckle 10 is latched. In this way, the second buckle member 14 is prevented from becoming inadvertently unlatched in either direction from the first buckle member 12 while the latch hooks 22 are engaged with latching apertures 18.

Each first end wall 52 also defines a first angled guide surface 58 and each second end wall 54 defines a second angled guide surface 60. The second angled guide surface 60 can be longer than the first angled guide surface 58 and can extend along the length of each second end wall 54. These angled guide surfaces 58, 60 guide the latch hooks 22 into the latching apertures 18 when the first and second buckle members 12, 14 are placed in sufficient proximity that the magnets 16, 20 can pull the first and second buckle members 12, 14 together. As such, precise manual alignment of the latch hooks 22 with the latching apertures 18 is not required.

The second buckle member 14 includes a first end 62 and a second end 64 defining a cavity 65. A bar 66 extends laterally across the cavity 65. The second end 4 of the strap is receivable in the cavity 65 and around the bar 66 as exemplified in FIGS. 1-2 to adjustably engage the strap 1 with the second buckle member 14. A keeper loop (not shown) can be placed around the strap 1 and used in a known manner to fix the second end 4 to the strap 1 and prevent the strap 1 from undesirably slipping around the bar 66 or disengaging from the second end 64 of the second buckle member 14.

The second buckle member 14 also includes a first side 67 defining an outer surface 68 and a second side 69 defining a joining surface 70 adapted to be joined with the mounting surface 40. The second side 69 can define a guide channel 72 in which the first buckle member 12 is receivable. The guide channel 72 can have an open first end 74 which can be coterminous with the first end 62 of the second buckle member 14, and a second end 76 which defines an end wall 78 having an angled guide surface 80. End wall 78 can separate the guide channel 72 from the cavity 65. The guide channel 72 can further include longitudinally extending side walls 82 which extend orthogonal to the joining surface 70 from the open first end 74 to the end wall 78. The side walls 82 can extend around and cover or mask the first buckle member 12 when the first buckle member 12 is received in the guide channel 72. This arrangement provides a polished aesthetic look and prevents the buckle 10 from snagging against objects or the environment.

The latch hooks 22 extend from the joining surface 70 and are adapted to engage the latching apertures 18 defined in the mounting surface 40 of the first buckle member 12. Each latch hook 22 includes an extension portion 84 extending from the joining surface 70 and a hook portion 86 extending from the extension portion 84. Each hook portion 86 defines a lip 88 adapted to engage the ledge 56 of a respective latching aperture 18 when the respective latch hook 22 is received in the latching aperture 18. At the same time, each latch hook lip 88 can also engage a vertical surface 57 of each first latching aperture end wall 52 below each ledge 56.

The second buckle member 14 also comprises locating means in the form of a flattened protuberance 90 adapted to engage the depression 44 extending from the joining surface 70 between the latch hooks 22 such that the latch hooks 22 are laterally spaced from the protuberance 90 and each other. The second magnet 20 can be secured at least partially within the protuberance 90 such that at least a portion of the magnet 20 extends beyond the joining surface 70. The protuberance 90 is positioned closer to the second end 64 of the second buckle member 14 than the latch hooks 22. The protuberance 90 is shaped and sized to engage the depression 44 defined in the mounting surface 40 of the first buckle member 12 when buckle 10 is latched. As such, the second magnet 20 extends beyond (i.e., crosses) the reference plane 42 into the depression 44 of the first buckle member 12 when the protuberance 90 is engaged with the depression 44. This arrangement offsets the first and second magnets 16, 20 along a joining axis 35 extending orthogonal to the reference plane (i.e., vertical), which facilitates the magnets 16, 20 in positioning and maintaining the second buckle member 14 in a latched condition with the first buckle member 12.

The protuberance 90 includes a plurality of angled side walls 92 which can correspond in angle or slope to the angled side walls 46 of depression 44 such that the angled side walls 92 of the protuberance 90 can translate along one or more of the angled side walls 46 of the depression 44 when the protuberance 90 is pulled into depression 44 by offset magnets 16, 20. This further facilitates alignment and engagement of the depression 44 by the protuberance 90 when the joining surface 70 is placed in proximity to the mounting surface 40, which in turn facilitates alignment of the latch hooks 22 with the latching apertures 18, and thus engagement of the latch hook lips 88 with the latching aperture ledges 56.

Figure 3:
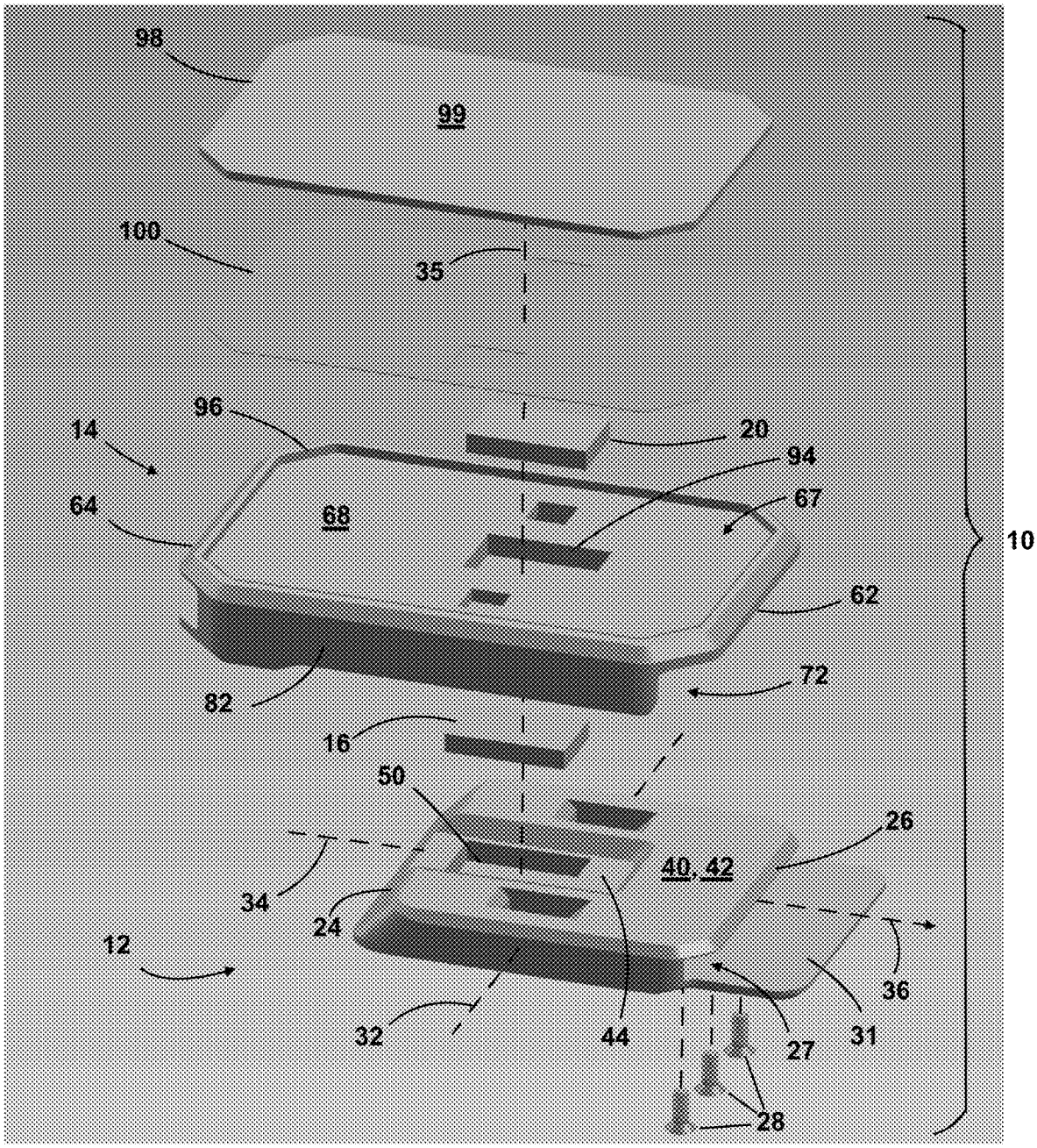
FIG. 3 is an elevated exploded isometric view of the buckle of FIG. 1.
Figure 4:
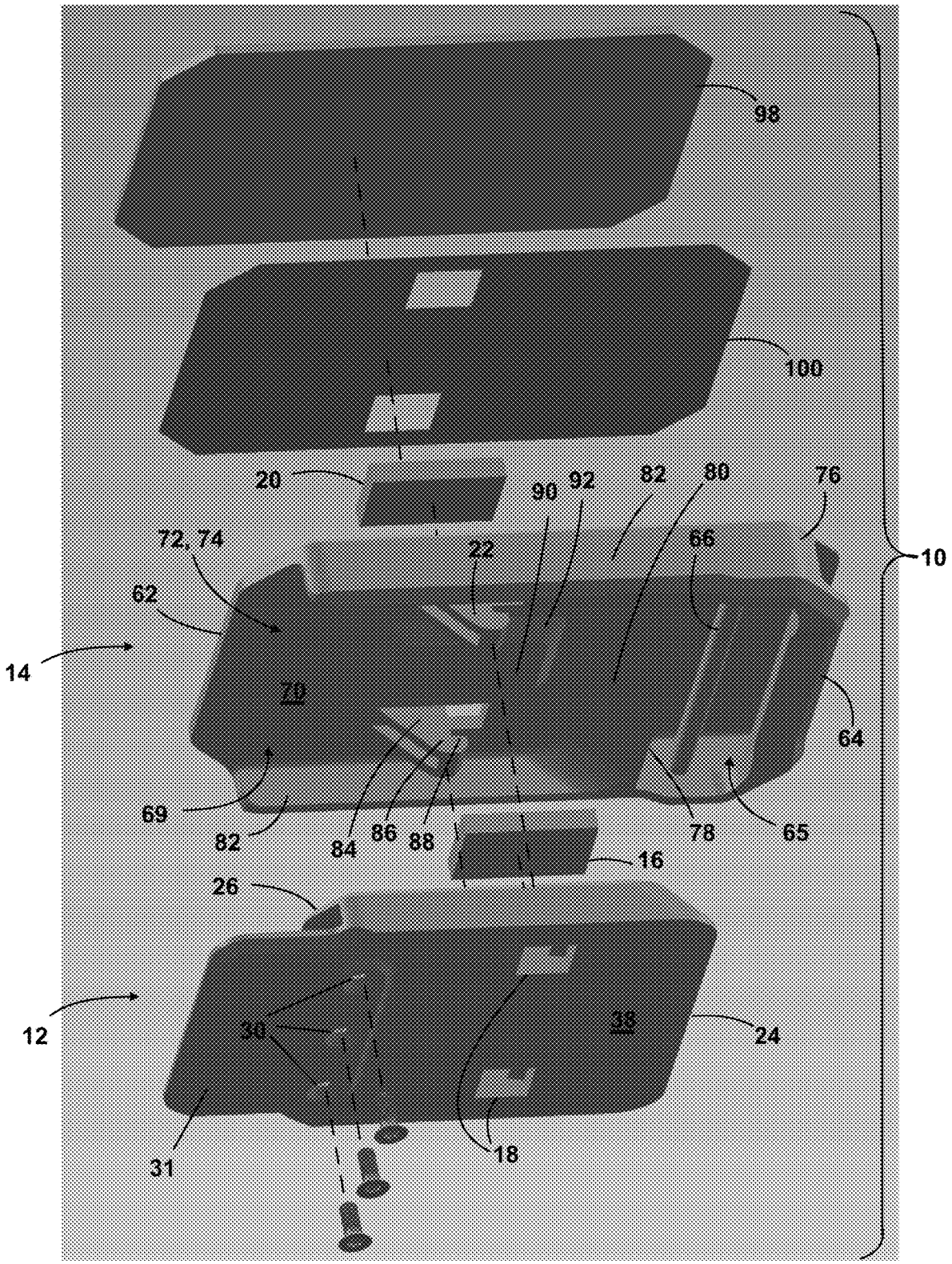
FIG. 4 is a depressed exploded isometric view of the buckle of FIG. 1.
Figure 5:
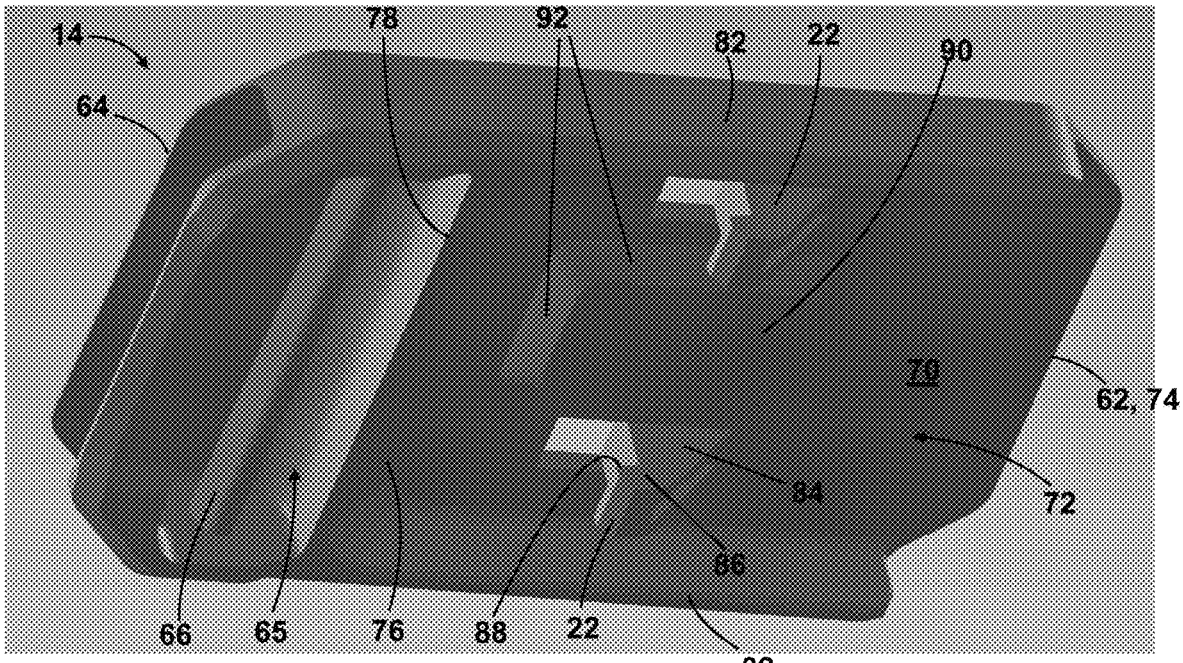
FIG. 5 is a depressed isometric view of the male buckle member of FIG. 1.
Figure 6:
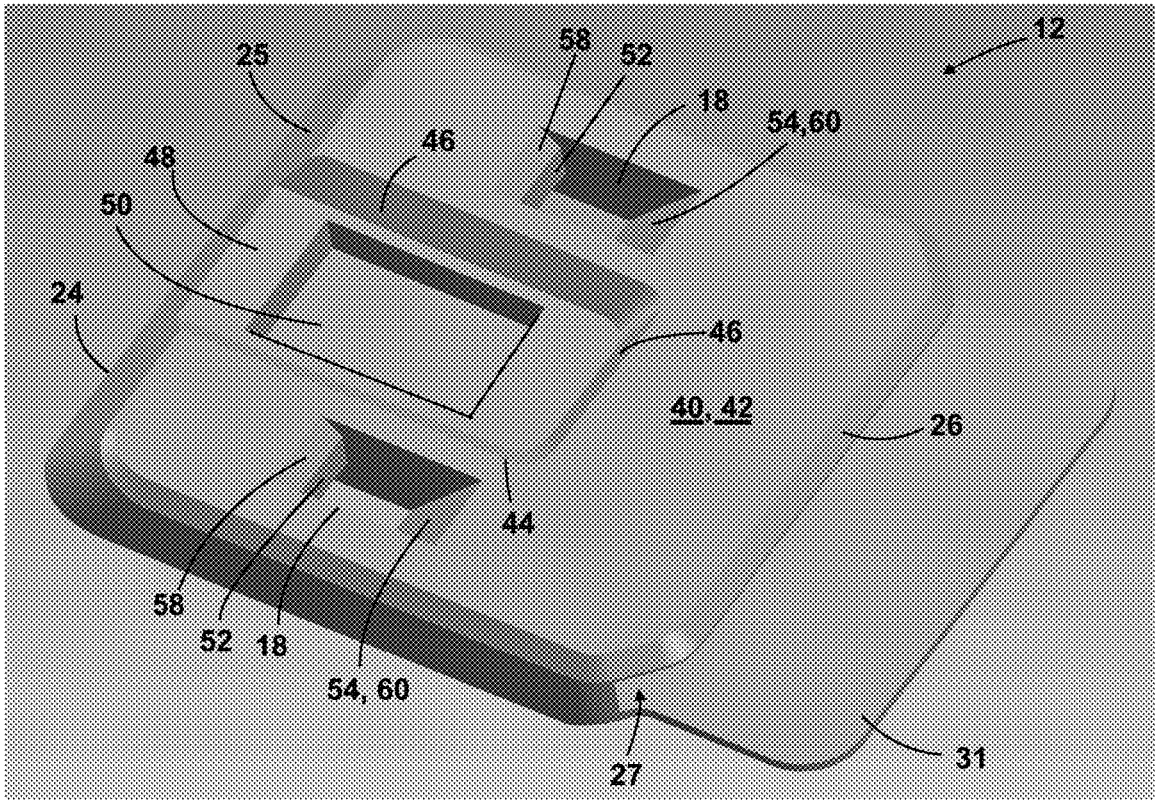
FIG. 6 is an elevated isometric view of the female buckle member of FIG. 1.
Figure 7:
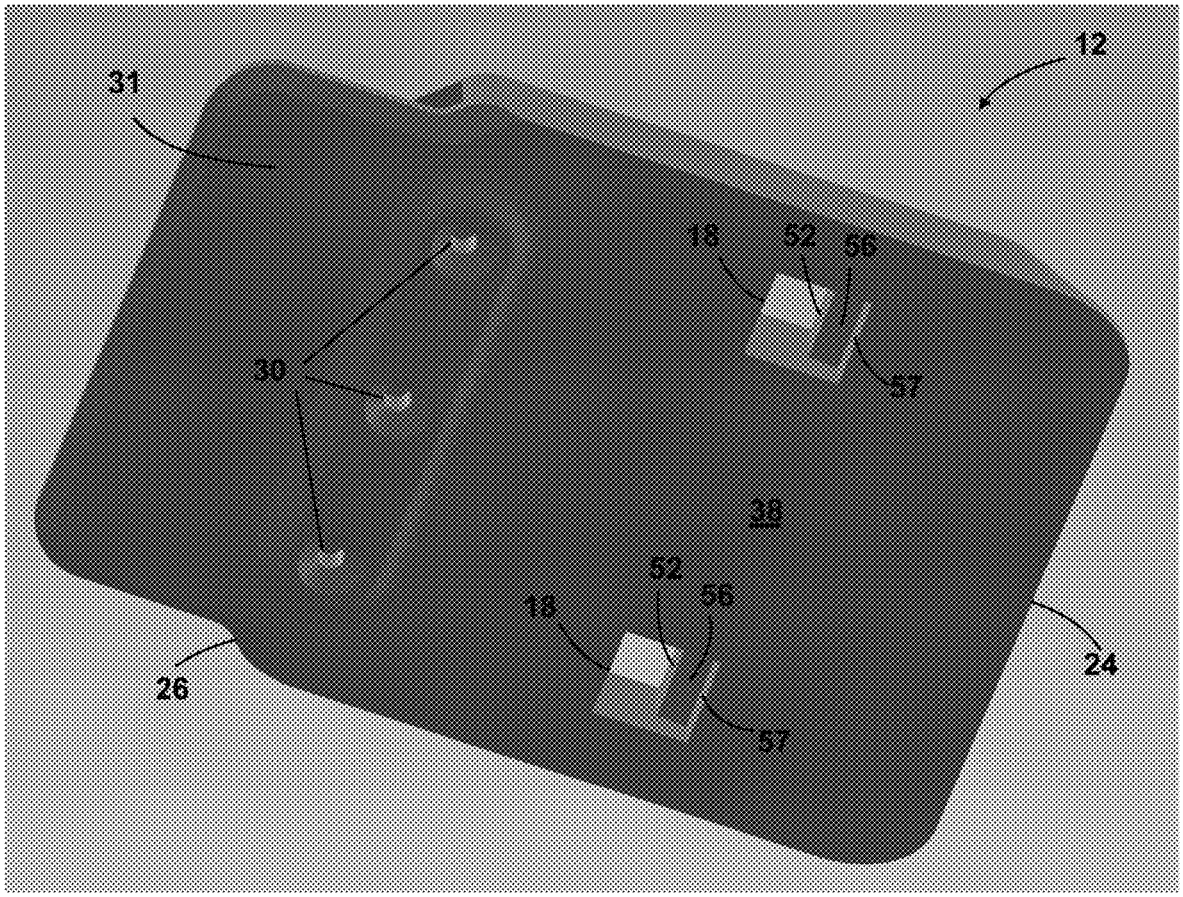
FIG. 7 is a depressed isometric view of the female buckle member of FIG. 1.
Figure 8:
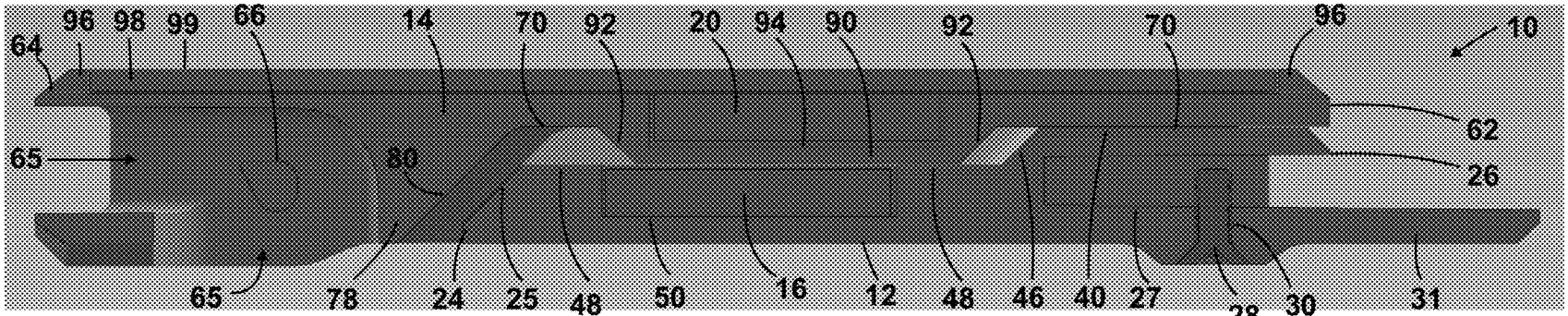
FIG. 8 is a first longitudinally sectioned side elevational assembled view of the buckle of FIG. 1.
Figure 9:
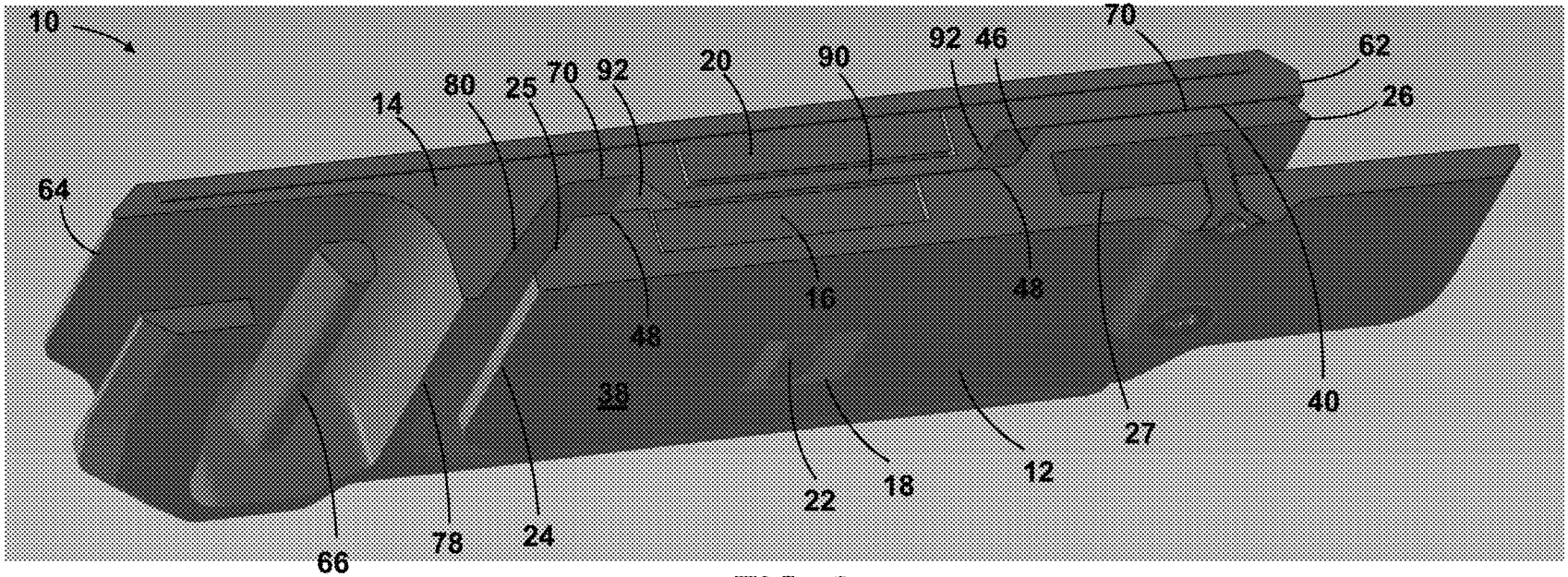
FIG. 9 is a first longitudinally sectioned isometric assembled view of the buckle of FIG. 1.

The second buckle member 14 can include a recess 94 sized and shaped to receive the second magnet 20 defined in outer surface 68 of the first side 67. The second magnet 20 can be secured in the recess 94 using securing means. The recess 94 can extend into the protuberance 90 such that the second magnet 20 extends beyond the joining surface 70 and at least partially into the protuberance 90. The recess 94, and thus the second magnet 20, can be located closer to the second end 64 of the second buckle member 14 than the first end 62. As shown in FIG. 3, this places the second magnet 20 longitudinally offset from the first magnet 16 when the buckle is latched 10, thus facilitating the first and second magnets 16, 20 pulling the latch hooks 22 into the latching apertures 18 and maintaining the latch hooks 22 in engagement with the latching apertures 18 when the buckle 10 is latched.

In some embodiments, a protruding rim 96 can extend outward from the outer surface 68 around a perimeter of the second buckle member 14. As such, the magnetic buckle 10 can further include a cover plate 98 adapted to be received against the outer surface 68 and within the area defined by the rim 96. The cover plate 98 can be secured to the outer surface 68 of the second buckle member 14 over the second magnet 20 and within the rim 96 such that a surface 99 of the cover plate 98 is substantially flush with the rim 96. The surface 99 of the cover plate 98 can be provided with decoration. The cover plate 98 can be secured to the outer surface 68 by any suitable securing means, including but not limited to adhesives and mechanical fasteners. For example, in one embodiment, the cover plate 98 is secured to the outer surface 68 via an adhesive layer or underlayment 100. The cover plate 98 can help secure the second magnet 20 in the second buckle member 14, and provides the assembled buckle 10 with a clean aesthetic appearance.

In use, the magnetic buckle 10 is releasably latched by placing the joining surface 70 of the second buckle member 14 in proximity to the mounting surface 40 of the first buckle member 12 with the first end 62 of the second buckle member 14 proximate to the second end 26 of the first buckle member 12 and the second end 64 of the second buckle member 14 proximate to the first end 24 of the first buckle member 12, as exemplified in FIG. 3.

As noted above and best shown in FIGS. 8-9, the first and second magnets 16, 20 are arranged within their respective buckle members 12, 14 so as to be offset from each other when the buckle 10 is latched. More specifically, the first and second magnets 16, 20 are longitudinally offset along the longitudinal axis 34 and vertically offset along a joining axis 35 which extends orthogonal to the reference plane 42 (i.e., vertical). The second magnet 20 is arranged within the second buckle member 14 further along the longitudinal axis 34 in the release direction 36 than the first magnet 16 within the first buckle member 12 so as to cause the magnetic attraction between the magnets to pull the latch hooks 22 and protuberance 90 of the second buckle member 14 into engagement with the latching apertures 18 and depression 44 and of the first buckle member 12, respectively, when the joining surface 70 is placed in proximity to the mounting surface 40. The protuberance 90 and the latch hooks 22 can translate obliquely along the angled guide surfaces of the depression 46 and latching apertures 58, 60 when the joining surface 80 is placed in proximity to the mounting surface 40. As such, the angled guide surfaces of the depression 46 and latching apertures 58, 60 guide the protuberance 90 and the latch hooks 22, respectively, into the depression 44 and latching apertures 18. With the latch hooks 22 received in the latching apertures 18, the offset magnets 16, 20 bias the lip 88 of each latch hook 22 into engagement with the ledge 56 of each latching aperture 18 and thereby maintain the first and second buckle members 12, 14 in a latched condition until the second buckle member 14 is manually disengaged from the first buckle member 12. Because the second magnet 20 is arranged at least partially within the protuberance 78, at least a portion of the magnet 20 extends across the reference plane 42 and into the depression 44 when the protuberance 90 is engaged with the depression 44. This also helps maintain the first and second buckle members 12, 14 in a latched condition.

Figure 10:
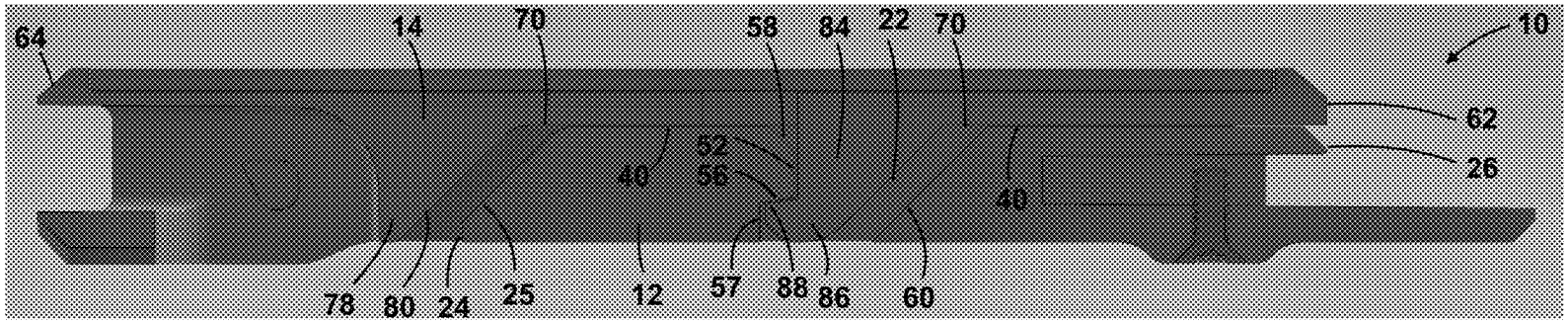
FIG. 10. is a second longitudinally sectioned side elevational assembled of the buckle of FIG. 1.
Figure 11:
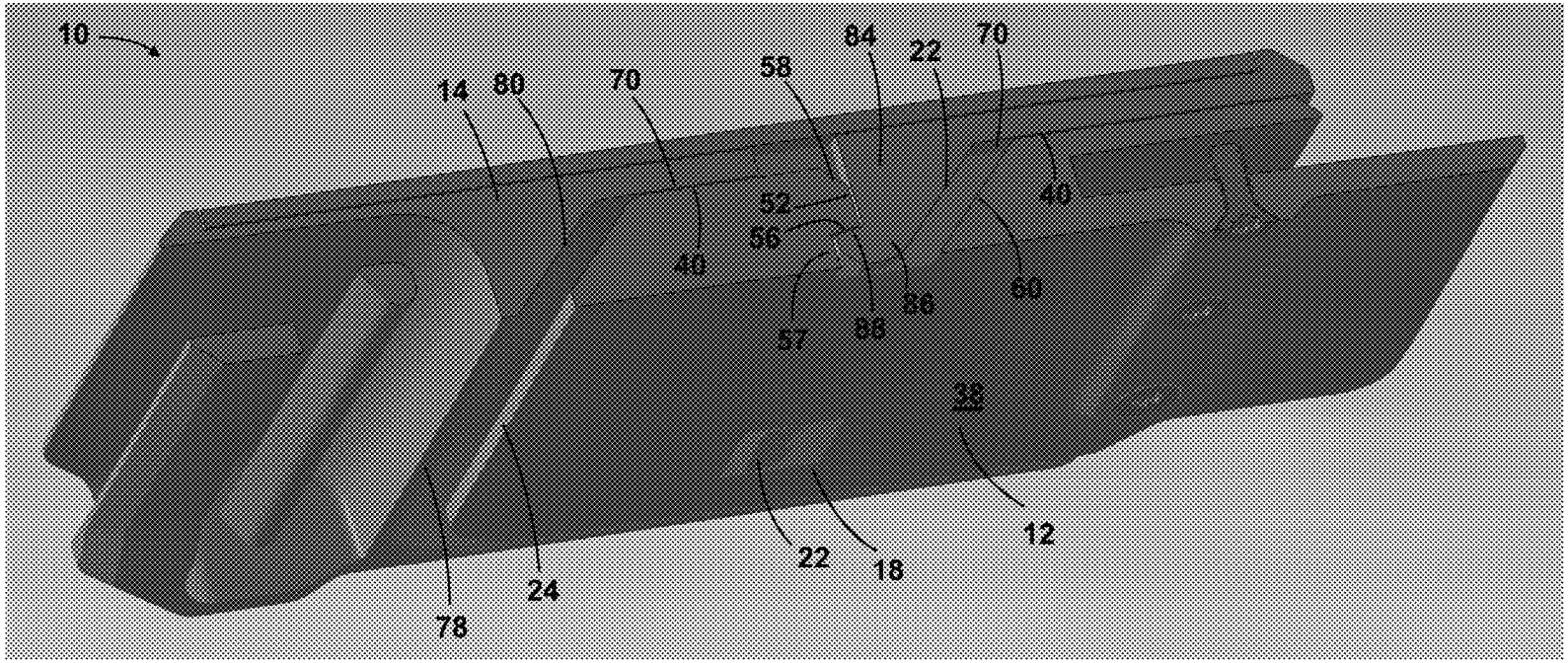
FIG. 11. is a second longitudinally sectioned isometric assembled view of the buckle of FIG. 1.
Figure 12:
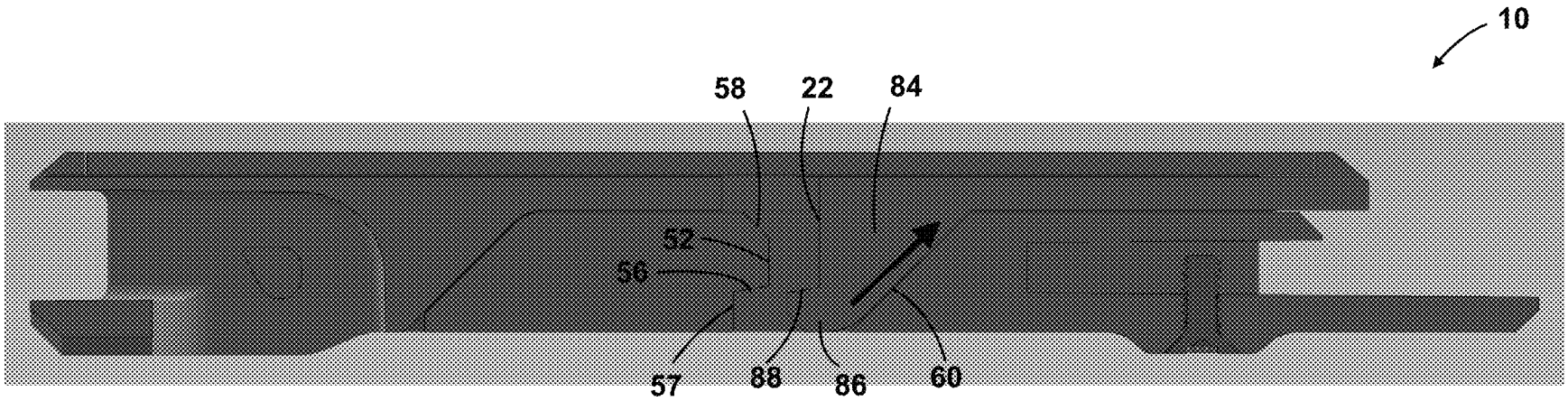
FIG. 12. is a third longitudinally sectioned side elevational assembled of the buckle of FIG. 1.
Figure 13:
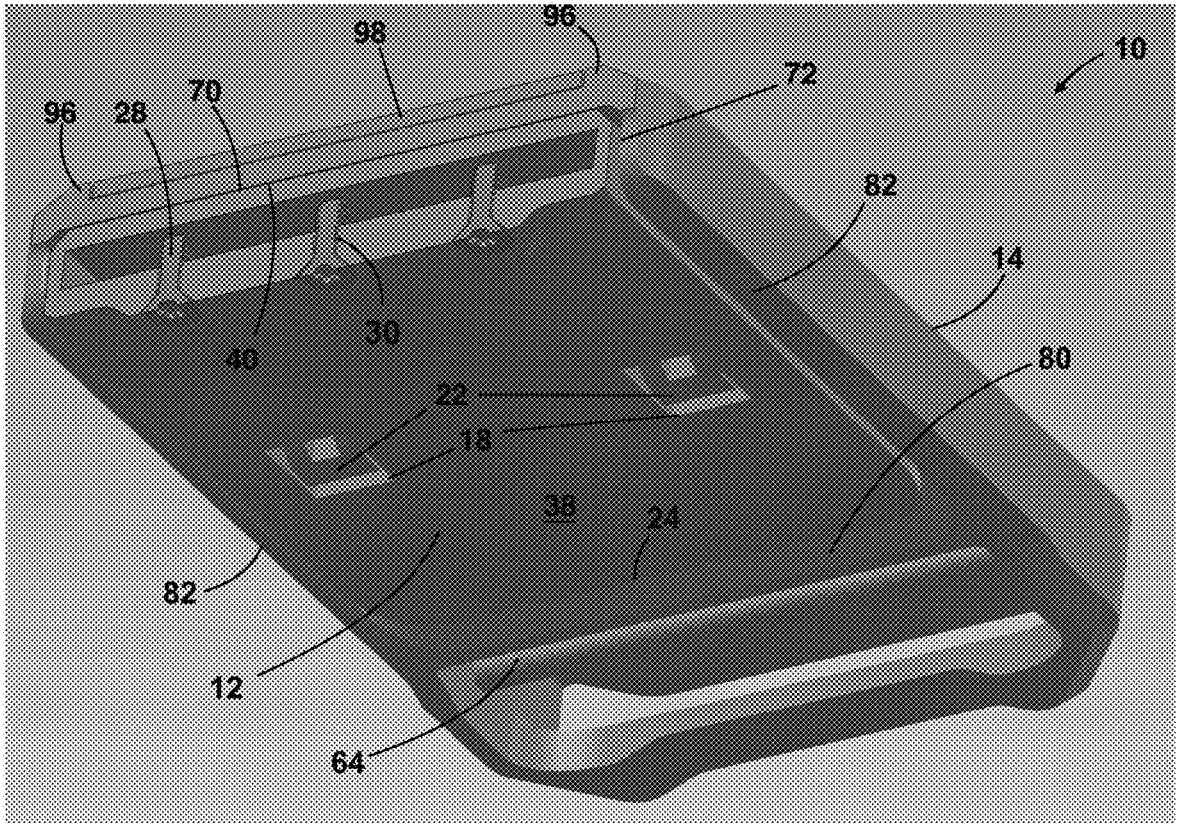
FIG. 13 is a first transversely sectioned isometric view of the buckle of FIG. 1.

As shown in FIGS. 10-12, displacement of the second buckle member 14 in the release direction 36 relative to the first buckle member 12 disengages the latch hook lips 88 from the latching aperture ledges 56. Further displacement of the second buckle member 14 in the release direction 36 relative to the first buckle member 12 translates the latch hooks 22 obliquely along the second angled guide surfaces 60 (indicated by an arrow) and out of the latching apertures 18 to release the second buckle member 14 from the first buckle member 12 and thereby unlatch the buckle 10. This displacement of the second buckle member 14 simultaneously disjoins the joining surface 70 from the mounting surface 40, and causes the angled surface 25 of the first end 24 of the first buckle member 12 to translate obliquely along the angled guide surface 80 of the end wall 78 of the guide channel 72 and out of the guide channel 72 to release the second buckle member 12 from the first buckle member 12. Displacement of the second buckle member 14 in the release direction 36 thus elevates the second buckle member 14 off of the mounting surface 40 of the first buckle member 12.

Figure 14:
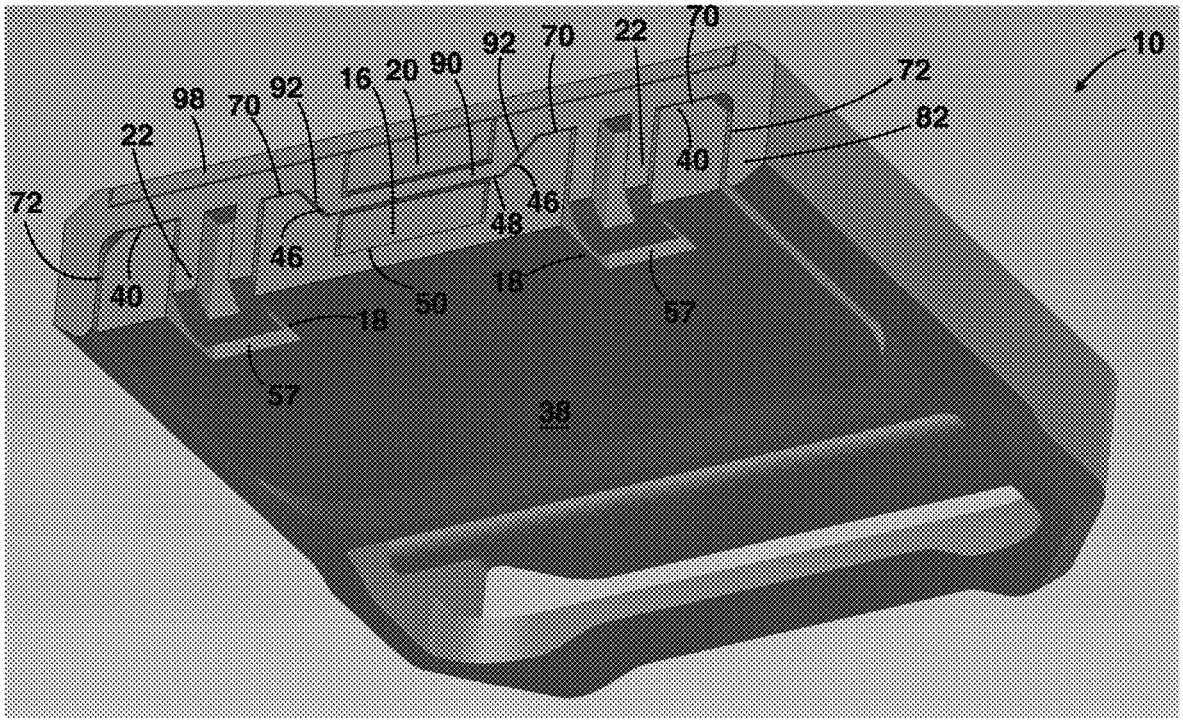
FIG. 14 is a second transversely sectioned isometric view of the buckle of FIG. 1.

As best shown in FIG. 14, the first and second magnets 16, 20 are not laterally offset from each other (i.e., they are laterally aligned) in order to maximize the attractive magnetic force exerted by the magnets upon the first and second buckle members 12, 14. However, in other embodiments, it is contemplated that it could be advantage to use additional magnets. In such case, it can also be advantageous to laterally offset some or all of the magnets.

Although embodiments of the present invention have been described in detail, it will be understood by those skilled in the art that various modifications can be made therein without departing from the spirit and scope of the invention as set forth in the appended claims. For example, it is contemplated that embodiments of the present invention could employ a fewer or a greater number of latch hooks from the embodiment depicted in the drawings. It is also contemplated that that embodiments of the present invention could employ latch hooks or other latching means having a different configuration from that of the latch hooks shown in the drawings.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims Thus, although there have been described particular embodiments of the present invention, it is not intended that such references be construed as limitations upon the scope of this invention except as set forth in the following claims.

What is claimed is:

1. A magnetic buckle, comprising:

a first buckle member comprising:

a first end and a second end adapted to engage a strap, a longitudinal axis extending between the first and second ends, a release direction extending along the longitudinal axis from the first end to the second end, a mounting surface defining a reference plane, at least one latching aperture defined in the mounting surface, and a first magnet; and a second buckle member comprising:

a joining surface adapted to be joined with the mounting surface, at least one latch hook extending from the joining surface, the latch hook adapted to engage the at least one latching aperture, and a second magnet;

wherein the first and second magnets join the joining surface with the mounting surface and pull the at least one latch hook into engagement with the at least one latching aperture when the joining surface is placed in proximity to the mounting surface; and wherein the second buckle member is prevented from being separated from the first buckle member when the second buckle member is pulled against the release direction or in a direction orthogonal to the reference plane while the at least one latch hook is engaged with the at least one latching aperture.

2. The buckle of claim 1, wherein the second magnet is longitudinally offset from the first magnet in the release direction when the at least one latch hook is engaged with the at least one latching aperture such that the first and second magnets bias the at least one latch hook into engagement with the at least one latching aperture.

3. The buckle of claim 2, wherein:

the second end of the first buckle member is adapted to securely engage a first end of the strap;

the second buckle member includes a first end and a second end adapted to adjustably engage a second end of the strap;

the first magnet is closer to the to the first end of the first buckle member than the second end of the first buckle member;

the second magnet is closer to the second end of the first buckle member than the first magnet when the at least one latch hook is engaged with the at least one latching aperture.

4. The buckle of claim 3, wherein the first magnet is closer to the first end of the first buckle member than the at least one latching aperture.

5. The buckle of claim 2, wherein:

the first magnet is recessed from the mounting surface; and the second magnet protrudes from the joining surface such that at least a portion of the second magnet crosses the reference plane when the joining surface is joined with the mounting surface.

6. The buckle of claim 5, wherein:

the at least one latch hook is laterally spaced from the second magnet; and the at least one latching aperture is laterally spaced from the first magnet.

7. The buckle of claim 5, further comprising:

a depression defined in the mounting surface of the first buckle member;

a recess defined in the first buckle member, the recess defined in either a bottom surface of the depression or in a backing surface of the first buckle member opposite the mounting surface; and a protuberance extending from the joining surface of the second buckle member; wherein:

the first magnet is secured in the recess, the second magnet is secured at least partially within the protuberance, and the first and second magnets pull the protuberance into the depression such that the protuberance engages the depression when the joining surface is placed in proximity to the mounting surface.

8. The buckle of claim 7, wherein the recess in which the first magnet is secured is closer to the first end of the first buckle member than the at least one latching aperture.

9. The buckle of claim 8, wherein:

the second buckle member includes an outer surface;

a second recess is defined in the outer surface;

the second recess extends into the protuberance; and the second magnet is secured in the second recess.

10. The buckle of claim 9, further comprising:

a rim protruding from a perimeter of the outer surface of the second buckle member; and a cover plate adapted to be secured to the outer surface of the second buckle member over the second magnet and within the rim such that a surface of the cover plate is substantially flush with the rim.

11. The buckle of claim 2, wherein:

the at least one latching aperture includes a first end wall defining a ledge with which the at least one latch hook is engageable to prevent the second buckle member from being separated from the first buckle member when the second buckle member is pulled either against the release direction or in a direction orthogonal to the reference plane; and the first end wall is closer to the first end of the first buckle member than the second end of the first buckle member.

12. The buckle of claim 11, wherein:

the at least one latching aperture includes a second end wall opposite the first end wall; and the second end wall defines an angled guide surface along which the at least one latch hook translates when pulled into engagement with the ledge by the first and second magnets.

13. The buckle of claim 11, wherein:

the at least one latch hook includes an extension portion extending from the joining surface and a hook portion defining a lip adapted to engage the ledge; and the first and second magnets bias the lip into engagement with the ledge.

14. The buckle of claim 13, wherein:

the second buckle member defines a first end and a second end configured to engage a second end of the strap;

the first end of the second buckle member is adjacent the second end of the first buckle member when the at least one latch hook is engaged with the at least one latching aperture; and displacement of the second buckle member in the release direction relative to the first buckle member disengages the lip from the ledge and translates the at least one latch hook along the angled guide surface and out of the latching aperture to release the second buckle member from the first buckle member.

15. The buckle of claim 14, wherein:

the second buckle member has a first side and a second side;

a guide channel in which the first buckle member is receivable is defined in the first side of the second buckle member;

the joining surface forms a portion of the guide channel;

the guide channel has a first open end at the first end of the second buckle member and a second end defining a sloped guide surface proximate to the second end of the second buckle member;

displacement of the second buckle member in the release direction relative to the first buckle member disengages translates the first end of the first buckle member along the sloped guide surface and out of the guide channel to release the second buckle member from the first buckle member.

16. A magnetic buckle, comprising:

a first buckle member comprising:

a first end and a second end adapted to engage an end of a strap, a longitudinal axis extending from the first end to the second end, a release direction extending along the longitudinal axis from the first end to the second end, a mounting surface defining a reference plane, a pair of latching apertures defined in the mounting surface, a first magnet; and a second buckle member comprising:

a joining surface adapted to be joined with the mounting surface, a pair of latch hooks extending from the joining surface, the pair of latch hooks adapted to prevent the second buckle member from being separated from the first buckle member when the second buckle member is pulled either against the release direction or in a direction orthogonal to the reference plane by engaging the pair of latching apertures, a second magnet;

wherein the first and second magnets join the joining surface with the mounting surface and pull the pair of latch hooks into engagement with the pair of latching apertures when the joining surface is placed in proximity to the mounting surface; and wherein the first magnet is longitudinally distal to the second end of the first buckle member relative to the second magnet when the pair of latch hooks are engaged with the pair of latching apertures.

17. The magnetic buckle of claim 16, wherein disengagement of the pair of latch hooks from the pair of latching apertures requires displacement of the second buckle member in the release direction relative to the first buckle member.

18. The magnetic buckle of claim 16, wherein:

the first buckle member further comprises:

a depression defined in the mounting surface between the pair of latching apertures, and a recess defined in the first buckle member such that at least a portion of the recess is closer to the first end of the first buckle member than the pair of latching apertures, wherein the first magnet is secured within the recess such that the magnet is recessed from the reference plane; and the second buckle member further comprises:

a protuberance extending from the joining surface between the pair of latch hooks, the protuberance adapted to engage the depression, wherein the second magnet is secured at least partially within the protuberance such that at least a portion of the second magnet extends across the reference plane into the depression when the protuberance is engaged with the depression;

wherein the first and second magnets pull the protuberance into engagement with the depression when the joining surface is placed in proximity to the mounting surface.

19. The magnetic buckle of claim 16, wherein:

each latching aperture includes a first end wall defining a ledge and a second end wall defining an angled guide surface;

the angled guide surface of each latching aperture is closer to the second end of the first buckle member than the first magnet;

each latch hook comprises an extension portion extending from the joining surface and a hook portion defining a lip adapted to engage the ledge of a respective latching aperture when the pair of latch hooks are pulled into engagement with the pair of latching apertures by the first and second magnets; and displacement of the second buckle member in the release direction relative to the first buckle member disengages the lip of each latch hook from the ledge of each latching aperture and translates pair of latch hooks along the angled guide surface and out of the pair of latching apertures to release the second buckle member from the first buckle member.

20. A magnetic belt, comprising:

a strap having a first end and a second end;

a first buckle member comprising:

a first end and a second end securely engaged with the first end of the strap, a longitudinal axis extending from the first end to the second end of the first buckle member, a release direction extending along the longitudinal axis from the first end to the second end of the first buckle member, a mounting surface defining a reference plane, at least one latching aperture defined in the mounting surface, and a first magnet secured within the first buckle member; and a second buckle member adjustably engaged with the second end of the strap, comprising:

a joining surface adapted to be joined with the mounting surface, at least one latch hook extending from the joining surface, the latch hook adapted to engage the at least one latching aperture, and a second magnet offset from the first magnet in the release direction;

wherein the first and second magnets join the joining surface with the mounting surface and pull the at least one latch hook into engagement with the at least one latching aperture when the joining surface is placed in proximity to the mounting surface; and wherein the second buckle member is only releasable from the first buckle member when the at least one latch hook is engaged with the at least one latching aperture by displacing the second buckle member in the release direction relative to the first buckle member.

* * * * *